US005308054A

United States Patent [19]

Sugito

[11] Patent Number: 5,308,054

[45] Date of Patent: May 3, 1994

[54] PAPER FEEDING DEVICE HAVING PAPER HAND FEED PATH

[75] Inventor: Takashi Sugito, Tenri, Japan

[73] Assignee: Sharp Kabushiki Kaisha, Osaka, Japan

[21] Appl. No.: 907,354

[22] Filed: Jul. 1, 1992

[30] Foreign Application Priority Data

Jul. 4, 1991 [JP] Japan ..... 3-164207

[51] Int. Cl.[5] ..... B65H 3/44

[52] U.S. Cl. ..... 271/9; 271/242

[58] Field of Search ..... 271/9, 242, 110, 265

[56] References Cited

U.S. PATENT DOCUMENTS

| | | | |
|---|---|---|---|
| 4,337,935 | 7/1982 | Sawada et al. | 271/9 |
| 4,394,008 | 7/1983 | Sugiyama | 271/9 |
| 4,548,394 | 10/1985 | Koyama et al. | 271/242 |
| 4,579,325 | 4/1986 | Pinckney et al. | 271/9 |
| 4,611,904 | 9/1986 | Wada | 271/265 |
| 4,786,041 | 11/1988 | Acquaviva et al. | 271/9 |
| 4,786,920 | 11/1988 | Igarashi | 271/9 |
| 4,881,729 | 11/1989 | Culligan et al. | 271/9 |
| 4,986,528 | 1/1991 | Watarai et al. | 271/265 |
| 5,072,923 | 12/1991 | Coy | 271/265 |
| 5,112,038 | 5/1992 | Ounaway | 271/242 |
| 5,156,385 | 10/1992 | Muto et al. | 271/9 |

FOREIGN PATENT DOCUMENTS

| | | | |
|---|---|---|---|
| 346220 | 12/1989 | European Pat. Off. | 271/242 |
| 3201403 | 8/1982 | Fed. Rep. of Germany . | |
| 3215815 | 11/1982 | Fed. Rep. of Germany . | |
| 206750 | 9/1986 | Japan | 271/9 |
| 62-21697 | 5/1987 | Japan . | |
| 64932 | 3/1989 | Japan | 271/9 |

OTHER PUBLICATIONS

Froula, J. D. "Single Sheet Paper Supply For Reproduction Apparatus With Document Length Sensor", *IBM Tech. Discl. Bull.* vol. 19, No. 3, pp. 802-803 (Aug. 1976).

*Primary Examiner*—David H. Bollinger

*Attorney, Agent, or Firm*—David G. Conlin; George W. Neuner

[57] ABSTRACT

A paper feeding device includes paper feed rollers in a paper hand feed path and a paper feed detection switch in front of the paper feed rollers. A drive section is provided for driving the paper feed rollers. A controller is provided such that the paper feed rollers pinch and hold the leading edge of a hand feed sheet of paper when the paper feed detection switch turns on.

3 Claims, 7 Drawing Sheets

PAPER FEEDING DEVICE HAVING PAPER HAND FEED PATH

BACKGROUND OF THE INVENTION

1. Field of the Invention

This invention relates to a paper feeding device used in an image forming mechanism of a laser printer, a copier or the like.

2. Description of the Related Art

FIG. 5 is a perspective view of a prior paper feeding device, FIGS. 6A to 6C are schematic diagrams for explaining its paper feeding operation, and FIG. 7 is its control flowchart.

As shown in FIG. 5, the prior paper feeding device comprises paper feed rollers 2 and 3, paper hand feed rollers 4 and 5 disposed in a paper hand feed path 1, and a drive section 6 for driving the paper feed rollers 2 to 5, the drive section including a motor 7, a gear mechanism 8, and a clutch 9. A paper feed detect switch 10 is provided for the paper feed rollers 2 and 3. A hand feed detect switch 11 is provided close to the paper hand feed rollers 4 and 5.

In the above arrangement, while the paper feeding device is in wait state, when paper 12 is sent to the hand feed path 1, the hand feed detect switch 11 is turned on as shown in FIG. 6A. When this occurs, the motor 7 is turned on and the paper 12 is fed by the hand feed rollers 4 and 5 (FIG. 6B). When the paper 12 comes to the paper feed detect switch 10, the clutch 9 is disengaged to prevent the paper 12 from being sent beyond the paper feed rollers 2 and 3. At this time, the leading edge of the paper 12 is located at the paper feed rollers 2 and 3 held by the clutch 9. Then, the motor 7 is turned off, the clutch is engaged, and the paper feeding device waits for a request to print (See FIG. 6C). After this, when a request to print is given, the motor 7 is turned on to drive the paper feed rollers 2 and 3 to send the paper to a printing section. When the paper is extracted, the hand feed detect switch 11 is turned off, and the process returns to the initial wait state. In FIG. 7, the process "FEED PAPER TO CASSETTE" indicates a case in which an automatic paper feed mechanism is operated.

However, in the above-mentioned prior art, the paper hand feed mechanism necessitates the switch 11 for detecting a hand feed, paper hand feed rollers 4 and 5, and a special holding mechanism. For this reason, the number of parts used is large, and their control is complicated.

It is therefore an object of the present invention to provide a paper feeding device having the reduced number of parts required.

As shown in FIGS. 1 and 2, the paper feeding device according to the present invention comprises paper feed rollers 24 and 25 disposed in the paper hand feed path 23, a drive section 26 for driving the paper feed rollers 24 and 25, a paper feed detect switch 27 arranged in front of and close to the paper feed rollers 24 and 25, and a controller 29 for outputting control signals to the above-mentioned drive section 26 to drive the paper feed rollers 24 and 25 in response to ON action of the paper feed detect switch 27 to pinch and hold the leading edge of the hand-fed paper 28 between them.

In the above-mentioned paper feeding device, in the case of paper hand feed, while it is in a wait state, when the paper 28 is supplied through the paper hand feed path 23 as shown in FIG. 3A, the paper feed detect switch 27 is turned on. Then, the controller 29 sends a signal to the drive section 26, whereby the paper feed rollers 24 and 25 are halted. Therefore, the paper 28 is not fed. While this state is maintained for a fixed period of time, the leading edge of the paper 28 is aligned at the paper feed rollers 24 and 25 (See FIG. 3B). After this, the paper feed rollers 24 and 25 are driven to feed the paper 28 by a fixed amount, whereby the paper 28 is pinched and held between the paper feed rollers 24 and 25 (See FIG. 3C). Then, the drive section 26 is turned off and waits for a request to print.

When a request to print is given, the controller 29 causes the paper feed rollers 24 and 25 to rotate, thereby supplying the paper 28 to the photosensitive body 35. At this time, when the paper 28 is extracted, the paper feed detect switch 27 is turned off, the paper feeding device returns to the initial wait condition.

According to the present invention, in the case of paper hand feed, the leading edge of the hand-fed paper is pinched and held by the paper feed rollers, and therefore, the paper can be held without a provision of a switch for detecting hand feed and an additional paper holding mechanism, so that the number of parts required can be reduced, and the reliability of paper feeding operation can be improved.

Further, there is no need to connect an additional paper holding mechanism to the motor of the drive section, therefore, it is possible to reduce the motor load.

Further objects and advantages of the present invention will be apparent from the following description of the preferred embodiment of the invention as illustrated in the accompanying drawings.

DETAILED DESCRIPTION OF THE PREFERRED EMBODIMENT

Figure 1:
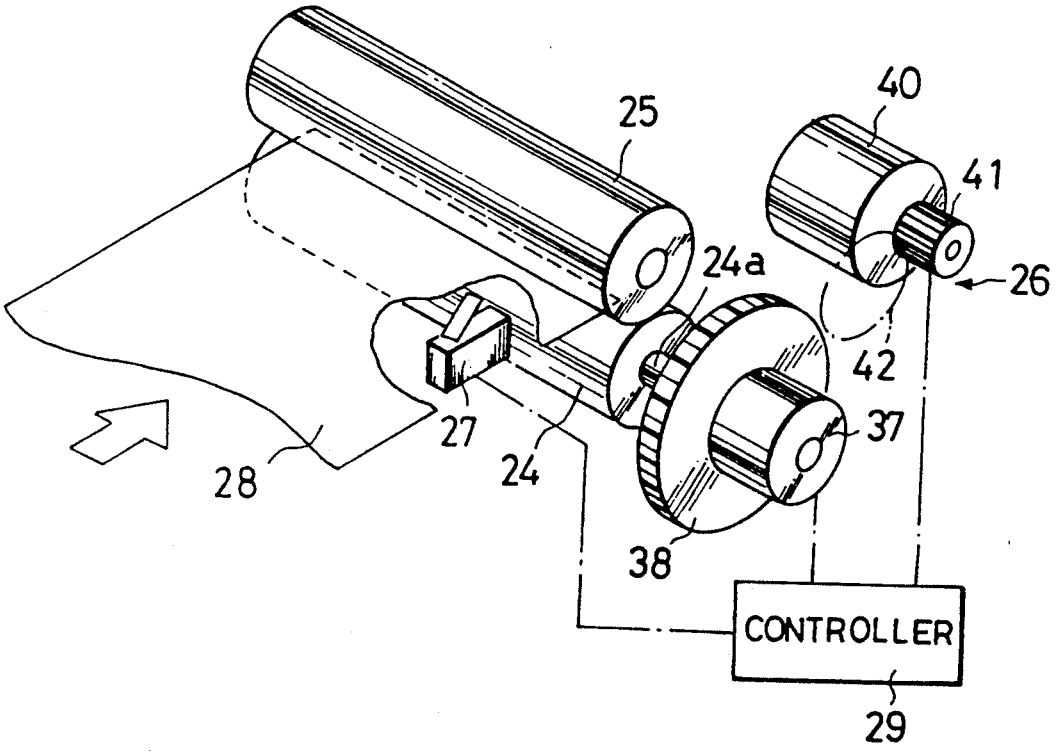
FIG. 1 is a perspective view of main components of a paper feeding device according to an embodiment of the present invention.
Figure 2:
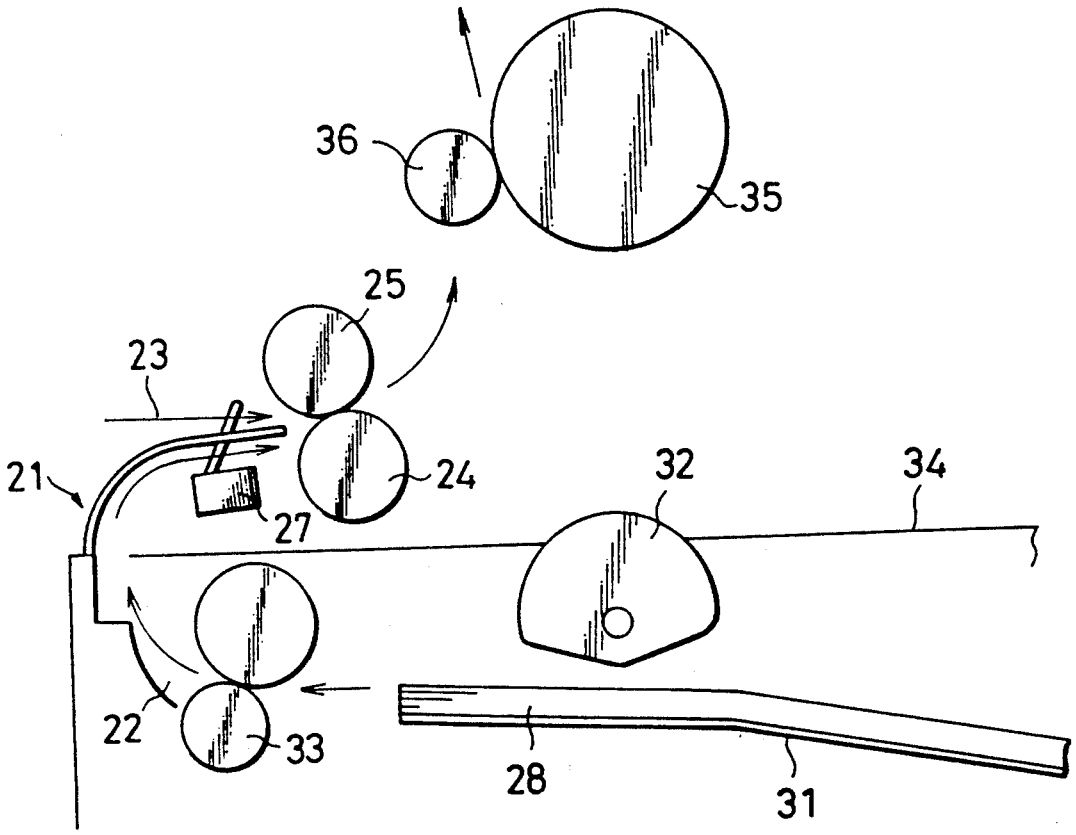
FIG. 2 is a schematic construction diagram of the paper feeding device of FIG. 1.
Figure 3A:
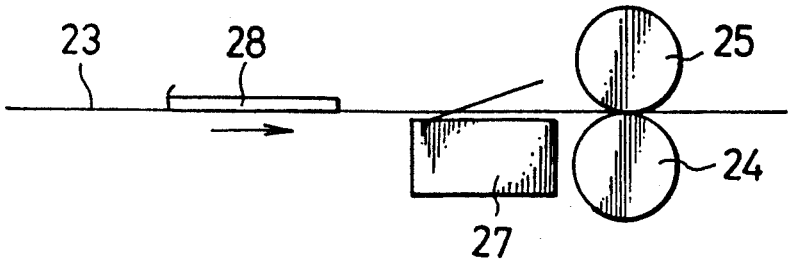
FIGS. 3A to 3C are explanatory diagrams of paper feeding operation of the device of FIG. 1.
Figure 3B:
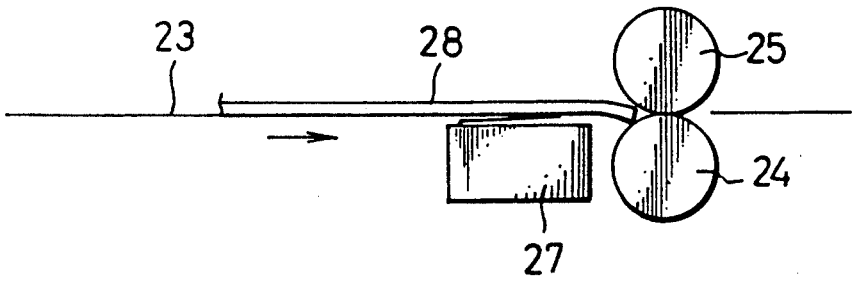
Figure 3C:
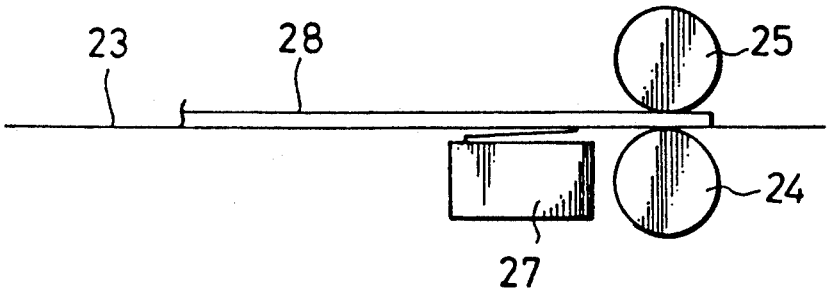
Figure 4:
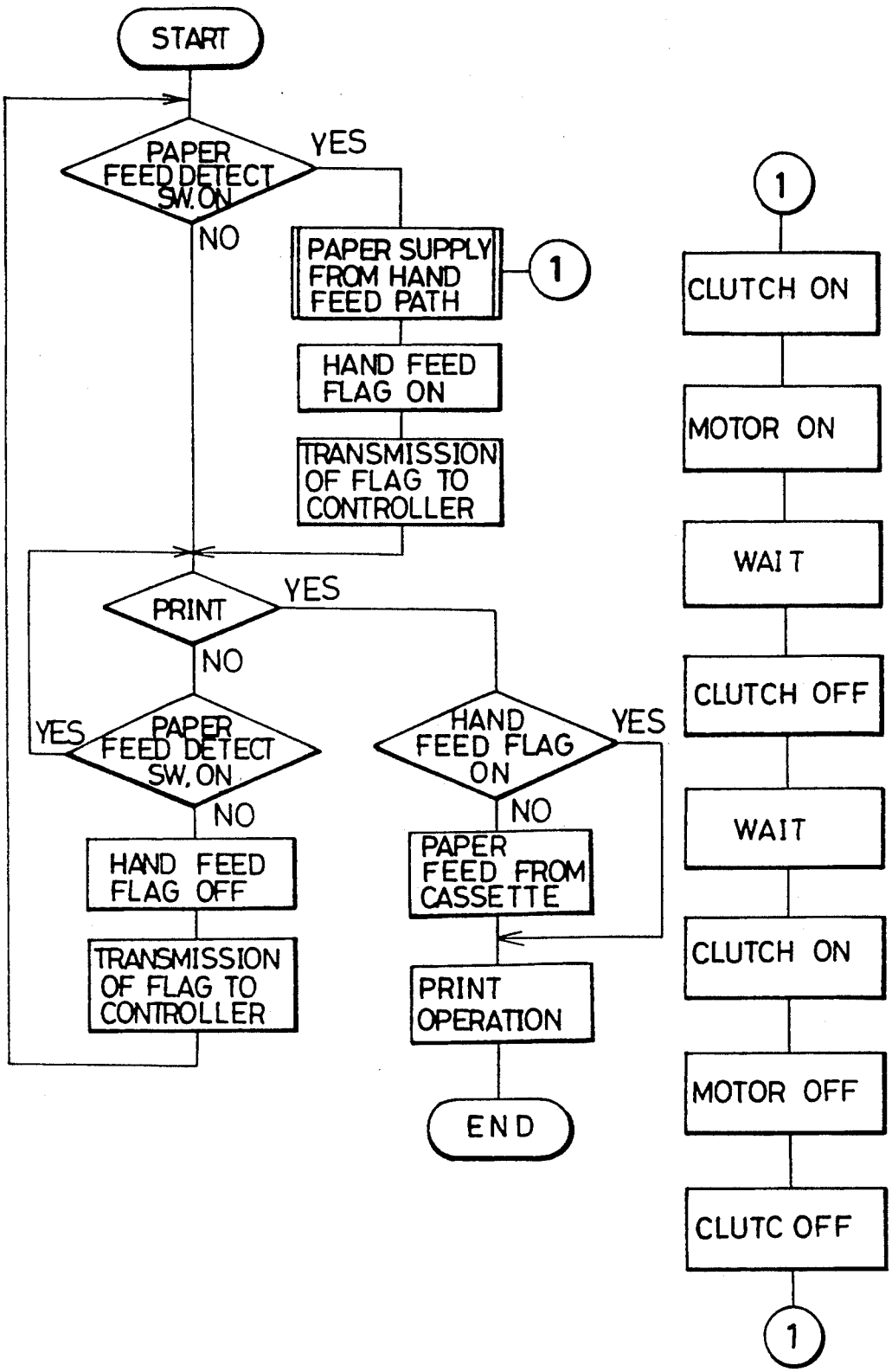
FIG. 4 is a paper feed control flowchart of the device of FIG. 1.
Figure 5:
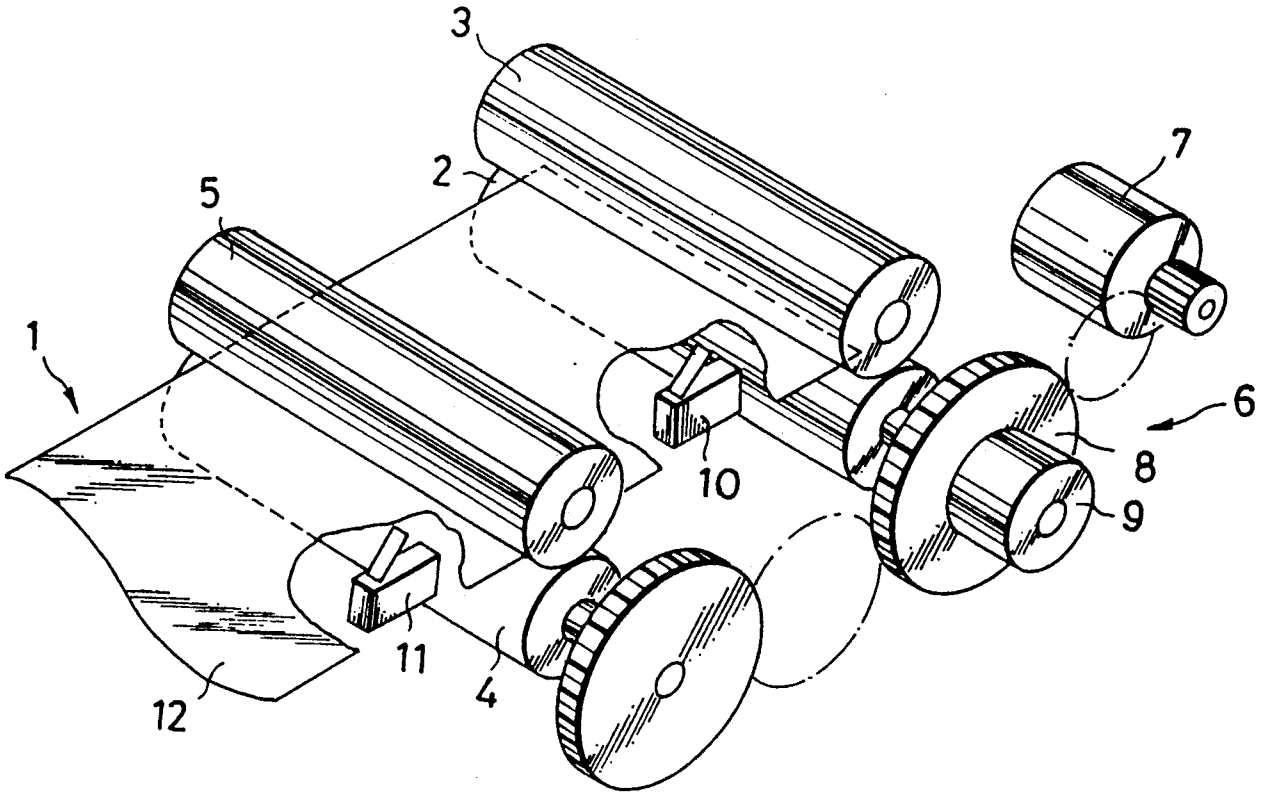
Fig. 5 PRIOR ART
FIG. 5 is a perspective view of a prior paper feeding device.
Figure 6A:
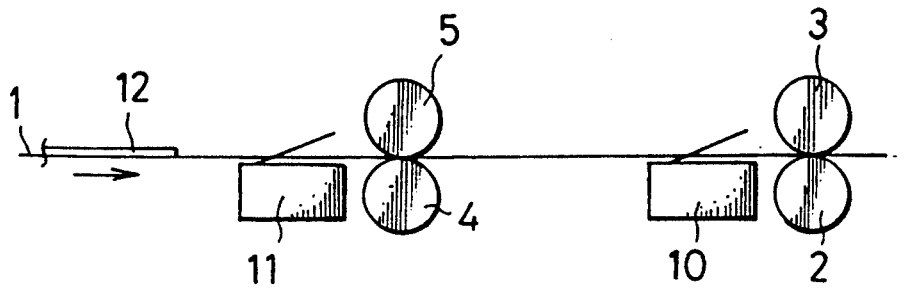
Fig. 6A PRIOR ART
FIGS. 6A to 6C are schematic diagrams of paper feed operation of the prior paper feeding device of FIG. 5.
Figure 6B:
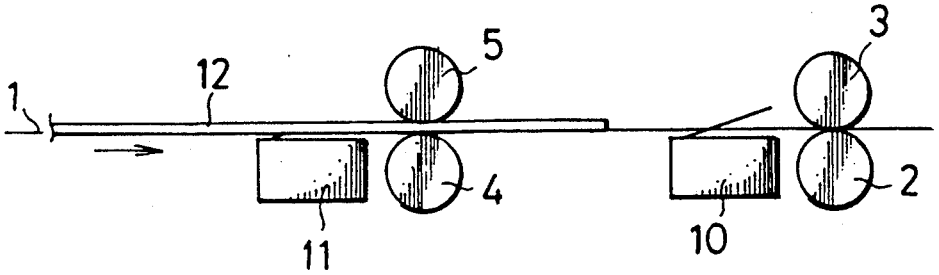
Fig. 6B PRIOR ART
Figure 6C:
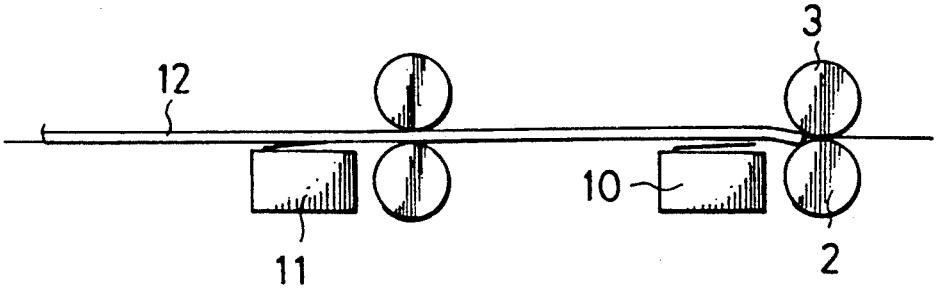
Fig. 6C PRIOR ART
Figure 7:
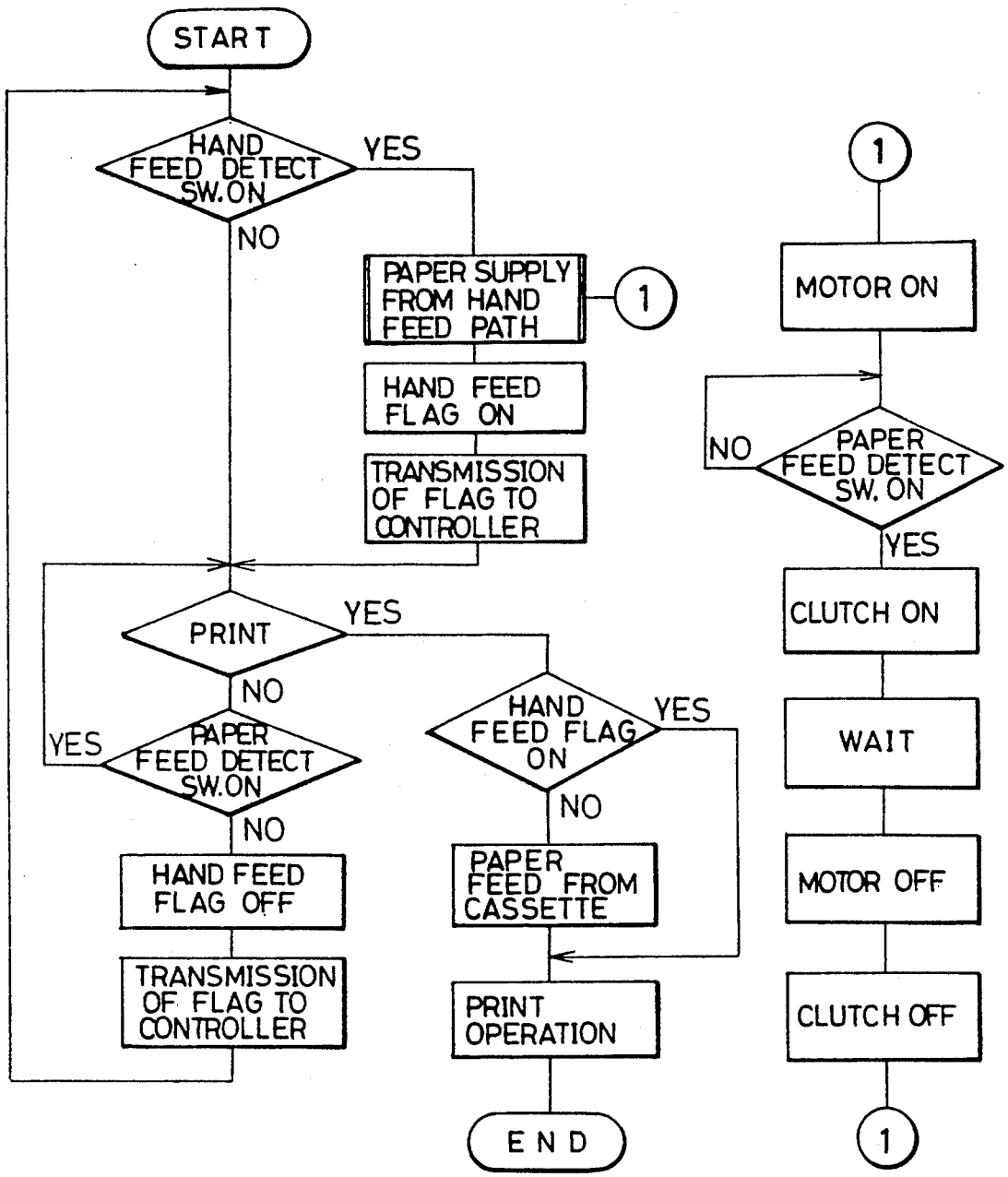
Fig. 7 PRIOR ART
FIG. 7 is a control flowchart of the prior paper feeding device of FIG. 5.

FIG. 1 is a perspective view of main components of a paper feeding device according to an embodiment of the present invention, FIG. 2 is a schematic construction diagram of the paper feeding device, FIG. 3 is an explanatory diagram of paper feeding operation while paper is fed, and FIG. 4 is a paper feed control flowchart.

As shown in FIGS. 1 and 2, the paper feeding device according to this embodiment is used in a laser printer, for example, and includes an automatic paper feed path 22 and paper hand feed path 23 provided in a paper feeding device body 21, paper feed rollers 24 and 25 disposed downstream of the junction of the two paper feed paths 22 and 23, a drive section 26 for driving the above-mentioned paper feed rollers 24 and 25, a paper feed detect switch 27 disposed in front of and close to the above-mentioned paper feed rollers 24 and 25, and a controller 29 for outputting control signals to the above-mentioned drive section 26 to drive the above-mentioned paper feed rollers 24 and 25 in response to ON action of the above-mentioned paper feed detect switch 27 to pinch and hold the leading edge of the hand-fed paper 28 between them.

The automatic paper feed path 22, as shown in FIG. 2, is U-shaped and leads sideways to the paper feed rollers 24 and 25. Along the path 22, there are disposed a paper tray 31, a pickup roller 32, and a conveying roller 33. The paper tray 31, pickup roller 32, and conveying roller 33 are included in an automatic paper feed cassette 34. However, the pickup roller 32 and the conveying roller 33 may be included in a printer body.

The paper hand feed path 23, as shown in FIG. 2, is formed in a straight line within the printer body. At the downstream side of the paper hand feed path 23, there are provided a drum-shaped photosensitive body 35 for forming an electrostatic latent image and a visible image on the surface thereof, and a transfer roller 36 opposed to the photosensitive body 35.

As shown in FIG. 1, a clutch 37 and the first gear 38 are secured to a roller shaft 24*a* of the lower driving paper feed roller 24.

The drive section 26 for driving the paper feed rollers 24 and 25 includes a motor 40, gear devices 41 and 42 for transmitting a driving force of the output shaft of the motor 40 to the first gear 38, and the clutch 37.

The above-mentioned paper feed detect switch 27, as shown in FIGS. 1 and 2, includes a microswitch disposed at the junction of the automatic paper feed path 22 and the paper hand feed path 23. This switch 27 may be a combination of a movable piece which turns when pushed by the paper 28 passing through the paper feed path, and a photo-interrupter whose optical path is blocked by the turning of the movable piece.

The above-mentioned controller 29 is an ordinary one-chip microcomputer, and has functions to switch between automatic paper feed and paper hand feed, and to control the drive section 26 by a signal from switches on an operation panel of the printer body and by a signal from the paper feed switch 27.

The paper feed operation of the above-mentioned arrangement will be described with reference to FIGS. 3 and 4. In case of paper hand feed, when the paper 28 is supplied from the paper hand feed path 23 in the wait state as shown in FIG. 3A, the paper feed detect switch 27 is turned on. Then, the controller 29 disengages the clutch 37, so that the paper feed rollers 24 and 25 are halted not to send the paper, and also stops the motor. At this time, since the clutch is disengaged, the paper feed rollers 24 and 25 do not rotate, and therefore, the paper 28 is not fed. While this state is maintained for a certain period of time, the leading edge of the paper 28 is aligned at the paper feed rollers 24 and 25 (See FIG. 3B). After that, the clutch is engaged and the paper 28 is sent by a fixed amount. Then, the clutch is disengaged. By this operation, the paper 28 is pinched and held between the paper feed rollers 24 and 25 (See FIG. 3C). F/llowing this, the motor is turned off, the clutch is engaged and a request to print is waited.

When a request to print is given, the controller 29 determines whether the flag of hand flag is ON or OFF, and if the hand feed flag is ON, the controller 29 drives the motor 40 to cause the paper feed rollers 24 and 25 to rotate in order to feed the paper 28 to the photosensitive body 35. At this time, if the paper 28 is extracted, the paper feed detect switch 27 is turned off, and the paper feeding device returns to the initial wait state.

In the case of automatic paper feed, when a request to print is given, the controller 29 determines whether the hand feed flag is ON, and if this flag is ON, it causes the pickup roller 32, the conveying roller 33 and the paper feed rollers 24 and 25 to be driven to feed the paper 28 from the paper tray 31, and a printing operation is performed.

In the case of automatic paper feed, the paper supplied from the paper tray 31, unlike in the case of paper hand feed, does not wait at the paper feed rollers 24 and 25, but undergoes a printing operation. Therefore, unless a request to print is given, paper is not supplied from the paper tray 31. When a request to print is not given, if the paper feed detect switch 27 is turned on, the controller 29 recognizes that the hand feed, keeps the paper being pinched and held between the paper feed rollers 24 and 25, and waits for a request to print. Under this condition, when a request to print is given, the paper not from the tray 31, is fed by the paper feed rollers 24 and 25.

The present invention is not limited to the above-mentioned embodiment, but many widely different embodiments of the present invention may be constructed without departing from the spirit and scope of the present invention.

What is claimed is:

1. A paper feeding device used in an image forming apparatus for feeding a sheet of paper into a main body of the image forming apparatus in response to a print request sent from the main body, said device comprising:

a paper hand feed path onto which a sheet of paper is to be supplied by an operator;

an automatic paper feed path onto 7hich a sheet of paper is to be supplied automatically;

a first roller couple disposed at said paper hand feed path for feeding a sheet of paper to the main body, said first roller couple including an upper roller and a lower roller;

a drive section for driving said first roller couple;

a paper feed detection switch disposed downstream of a junction of said paper hand feed path and said automatic paper feed path and in front of said first roller couple for detecting a sheet of paper supplied into said paper hand feed path and generating a detection signal upon detection of a sheet of paper;

a controller connected to receive said detection signal for controlling in response to said detection signal said drive section such that said first roller couple feeds a supplied sheet of paper by inserting a leading edge thereof into said first roller couple to set said leading edge between said upper and lower rollers and said supplied sheet of paper is kept where it is until receiving the print request; and a second roller couple to be driven by said drive section disposed at said automatic paper feed path;

said controller controlling said drive section in response to the print request such that said first and second roller couples feed a sheet of paper from a paper tray to the main body in the absence of a sheet of paper in said paper hand feed path.

2. A paper feeding device according to claim 1, wherein said paper feed detection switch includes a movable piece which turns when pushed by a supplied paper and a photo-interrupter for detecting that an optical path is blocked by said movable piece.

3. A paper feeding device according to claim 1, further comprising a hand feed flag setting means for setting a hand feed flat upon detection of the sheet of paper in said hand feed path.

said controller controlling said drive section in response to the print request such that said first roller feed said supplied sheet of paper from a hand feed path to the main body when said hand feed flag has been set and such that said first and second rollers feed said sheet of paper from the paper tray to the main body when said hand feed flag has not been set.

* * * * *